US006059387A

United States Patent [19]

Echard et al.

[11] Patent Number: 6,059,387

[45] Date of Patent: May 9, 2000

[54] RECEPTACLE FOR RECEIVING FLUID

[75] Inventors: W. Edward Echard, Germantown; Gerald F. Pullias, Oakland; William O. West, Chevy Chase, all of Md.

[73] Assignee: Plastic Solutions, L.L.C., Washington, D.C.

[21] Appl. No.: 09/154,214

[22] Filed: Sep. 16, 1998

[51] Int. Cl.[7] ..... A47B 77/06

[52] U.S. Cl. ..... 312/229; 220/571

[58] Field of Search ..... 312/229; 11/330.1; 220/571; 4/630; 137/312

[56] References Cited

U.S. PATENT DOCUMENTS

| | | | |
|---|---|---|---|
| 2,514,001 | 7/1950 | Knuth | 312/229 X |
| 2,592,394 | 4/1952 | Cochran | 312/229 X |
| 4,369,532 | 1/1983 | Houchins et al. . | |
| 4,903,723 | 2/1990 | Sublett . | |
| 5,099,873 | 3/1992 | Sanchez | 220/571 X |
| 5,289,597 | 3/1994 | Sidola . | |
| 5,291,921 | 3/1994 | Devine | 220/571 X |
| 5,346,094 | 9/1994 | Strawser | 220/571 |
| 5,452,739 | 9/1995 | Mustee et al. . | |
| 5,577,539 | 11/1996 | Shaw et al. | 220/571 X |
| 5,645,103 | 7/1997 | Whittaker | 220/571 X |
| 5,795,043 | 8/1998 | Johnson et al. | 312/229 |

*Primary Examiner*—Peter M. Cuomo
*Assistant Examiner*—Hanh V. Tran
*Attorney, Agent, or Firm*—Roylance, Abrams, Berdo and Goodman, L.L.P.

[57] ABSTRACT

A receptacle for receiving fluid such as water that is preferably placed within a cabinet supporting a sink. The receptacle is preferably positioned adjacent the bottom of the cabinet. The receptacle is preferably formed with flexible, flared sides and a frangible front portion to enable the receptacle to fit within a variety of differently sized cabinets. The receptacle can have a hole and funnel for alignment with a mating aperture in the cabinet above the toe-receiving recess of the cabinet. Thus, leaking water from the sink pipes can be directed through the aperture in the cabinet and onto the floor in front of the cabinet to bring the leak to the attention of the user of the sink. Alternatively, the receptacle can dispense with the hole in the receptacle and instead allows the leaking water to flow out the front of the cabinet to accomplish the same goal as the first embodiment Also, a cabinet and receptacle assembly can be used together to provide a device and method for receiving fluid and directing fluid from a fluid conductor to a surface in front of a cabinet.

21 Claims, 4 Drawing Sheets

RECEPTACLE FOR RECEIVING FLUID

FIELD OF THE INVENTION

The invention relates generally to a receptacle for receiving fluid. More specifically, the invention relates to a receptacle that can be placed under an apparatus that conducts fluid; such as a sink or a pipe, to catch leaking fluid such as water and divert the fluid to a location where it will cause little or no damage and be more readily noticed so that a repair can occur more quickly.

BACKGROUND OF THE INVENTION

Commonly, when a sink or its plumbing leak, the leaking water drips onto the bottom of the cabinet, which supports the sink. Then, the leaking water not only damages the bottom of the cabinet, but proceeds past the bottom of the cabinet to damage the floor on which the cabinet rests and so on. Additionally, since the cabinet is generally an enclosed structure, this leaking and the damage it causes goes unnoticed and continues indefinitely until the leaking water or the damage is discovered.

Attempts have been made in the prior art to catch water leaking from various apparatus, including from sinks and from dish washing machines. However, these prior art devices do not provide for controlled removal of the water and/or are not easily and inexpensively installed as an efficient retrofit, i.e., something added on to an apparatus already functioning in its intended manner.

Examples of prior art devices to catch leaking fluid are disclosed in the following U.S. Pat. Nos.: 4,369,532 to Houchins et al.; 4,903,723 to Sublett; 5,289,597 to Sidola; and 5,452,739 to Mustee et al.

Thus, there is a continuing need to provide a receptacle for receiving fluid, especially for a receptacle that can provide for controlled removal of water and that provides an easy and inexpensive retrofitting capability. This invention addresses these needs in the art as well as other needs, which will become apparent to those skilled in the art once given this disclosure.

SUMMARY OF THE INVENTION

One object of the present invention is to provide a receptacle for receiving fluid.

Still another object of the invention is to provide a receptacle that can be placed under an apparatus that conducts fluid; such as a sink or a pipe, to catch leaking fluid and divert the fluid to a location where it will cause little or no damage and be more readily noticed so that a repair can occur more quickly.

Yet another object of the invention is to a receptacle that can provide for controlled removal of fluid and that provides an easy and inexpensive retrofitting capability.

A further object of the invention is to provide a cabinet-sink-receptacle assembly that prevents leaking fluid from damaging the cabinet and provides notification of a leak.

Still a further object of the invention is to provide a method of conducting fluid from a pipe through a receptacle and out of a structure to prevent damage to the structure by the fluid.

Still a further object of the invention is to provide a receptacle that is economically manufactured.

The foregoing objects are basically attained by providing a receptacle for receiving fluid, comprising: a base having a receiving area, a front member coupled to the base; a rear member coupled to the base; and first and second sides coupled to the base, the receiving area having a perimeter and being defined by the front member, the rear member, and the first and second sides adjacent the perimeter, and the rear member, and the first and second sides extending above the receiving area, one or more sections of the base, the front member, the rear member, and the first and second sides forming a support portion for supporting the receptacle, the support portion lying in a substantially horizontal first plane, and the first side being flexible and having an adjustable positioning portion.

The foregoing objects are further attained by providing a receptacle for receiving fluid, comprising: a base having a receiving area, a front member coupled to the base; a rear member coupled to the base; and first and second sides coupled to the base, the receiving area having a perimeter and being completely surrounded by the front member, the rear member, and the first and second sides adjacent the perimeter, and the rear member, and the first and second sides extending above the receiving area, one or more sections of the base, the front member, the rear member, and the first and second sides forming a support portion for supporting the receptacle, the support portion lying in a substantially horizontal first plane, and the front member extending from the base in a first direction that is generally away from the receiving area and the front member having a bottom surface being substantially coplanar with the first plane, the front member further having a main portion and a frangible portion for selectively removing from the receptacle.

The foregoing objects are further attained by providing a receptacle for receiving fluid, comprising: a base having a receiving area, the receiving area having a perimeter, an upper surface, a lower surface, and an opening in the upper surface, the base further having a conduit coupled to the lower surface and extending below the lower surface; a front member coupled to the base; a rear member coupled to the base; and first and second sides coupled to the base, the receiving area being defined by the front member, the rear member, and the first and second sides adjacent the perimeter, and the rear member, and the first and second sides extending above the receiving area.

The foregoing objects are still further attained by providing an assembly for receiving fluid, comprising: a cabinet foundation for positioning on a floor, the base having a lower floor contacting section and a support section positioned above the floor contacting section, the support section having a flange extending beyond the floor contacting section, the flange having a hole extending completely through the flange and the hole being spaced from the floor, and a receptacle positioned on the support section, the receptacle having a base, a front member coupled to the base, a rear member coupled to the base, and first and second sides coupled to the base, the base having a receiving area having a perimeter, an upper surface, a lower surface, and an opening extending completely through the receiving area between the upper and lower surfaces and the opening being aligned with the hole in the flange to permit fluid to pass from the upper surface of the base, through the base and the flange, and onto the floor, and the receiving area being defined by the front member, the rear member, and the first and second sides adjacent the perimeter, and the rear member and the first and second sides extending above the receiving area.

The foregoing objects are still further attained by providing a method for directing fluid from a fluid conductor to a platform, comprising the steps of: providing a fluid conductor above a platform; providing a cabinet foundation positioned on the platform, the foundation having a lower platform contacting section and a support section positioned above the platform contacting section, the support section having a flange extending beyond the platform contacting section, the flange having a hole extending completely therethrough and being spaced from the platform; providing a receptacle having a base, a front member coupled to the base, a rear member coupled to the base, and first and second sides coupled to the base, the base having a receiving area having a perimeter, an upper surface, a lower surface, and an opening extending completely through the receiving area between the upper and lower surfaces; positioning the receptacle on the support section of the foundation beneath the fluid conductor such that the opening of the receptacle is aligned with the hole in the flange of the cabinet base; and directing fluid from the fluid conductor to the platform by permitting the water to flow onto the receptacle and then pass through the opening in the receptacle and through the hole in the flange.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
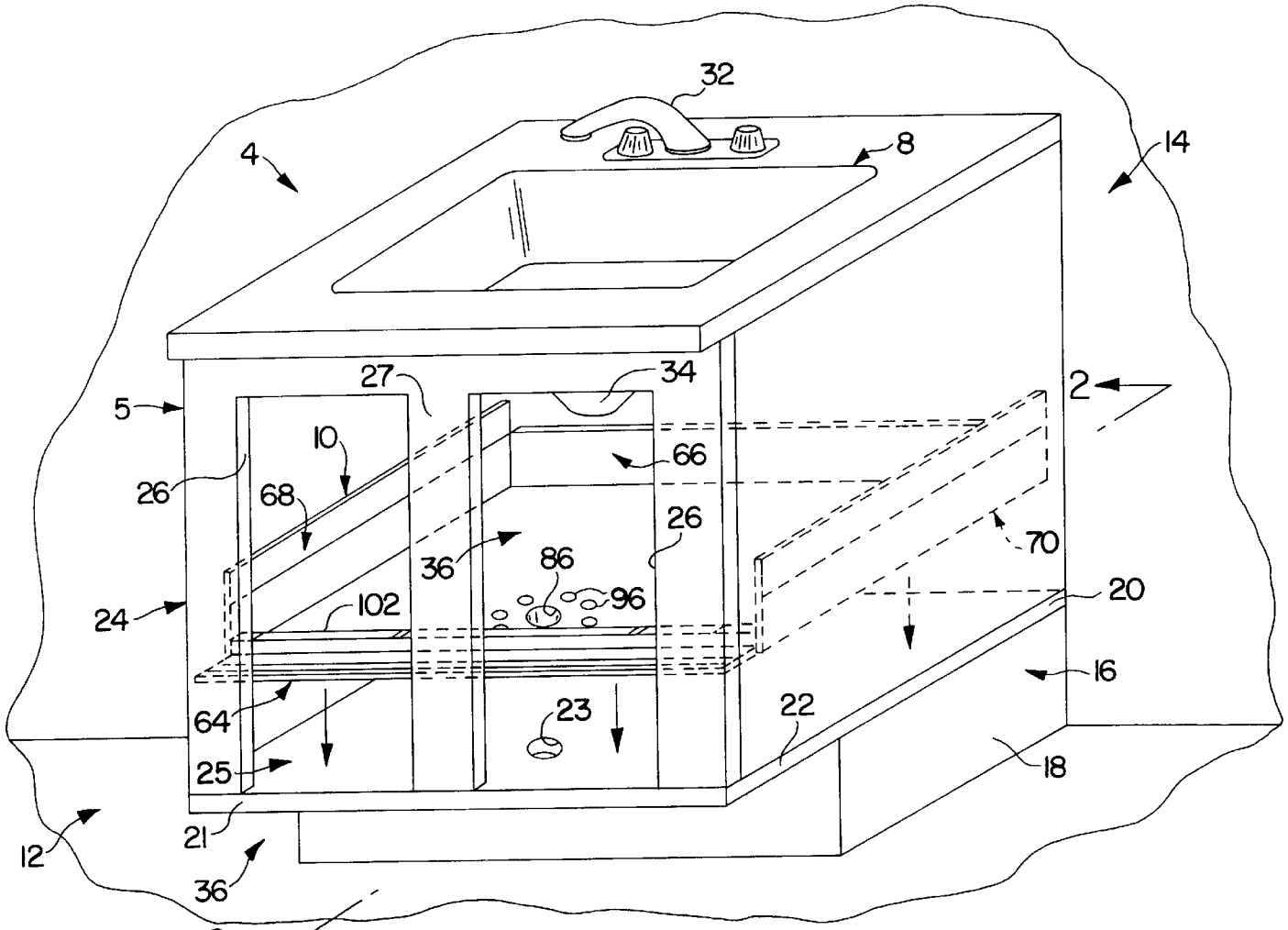
FIG. 1 is a perspective view of the cabinet-sink-receptacle assembly in accordance with a first embodiment of the present invention illustrating the receptacle being placed in its functioning position within the cabinet.
Figure 2:
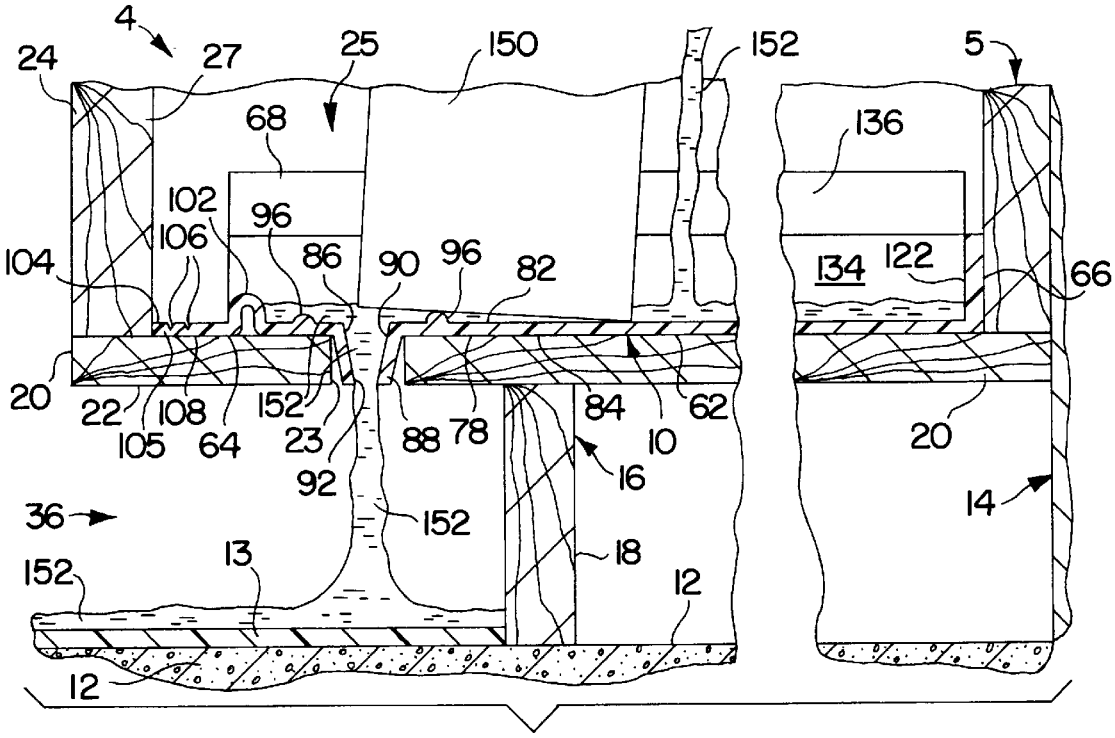
FIG. 2 is a cross-section view of the cabinet-sink-receptacle assembly in accordance with the present invention illustrating the receptacle located in its functioning position within the cabinet and illustrating an article or container placed over the drain opening but spaced from the drain opening by protrusions, while water flowing from pipes is caught by the receptacle and directed through the drain hole and flange of the cabinet and onto the floor adjacent the toe-receiving area of the cabinet.
Figure 3:
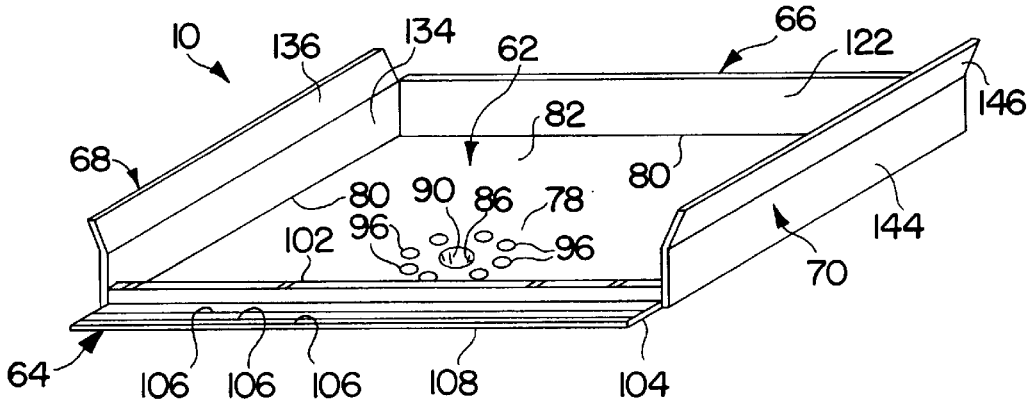
FIG. 3 is a perspective view of the receptacle in accordance with the present invention prior to insertion within the cabinet.
Figure 4:
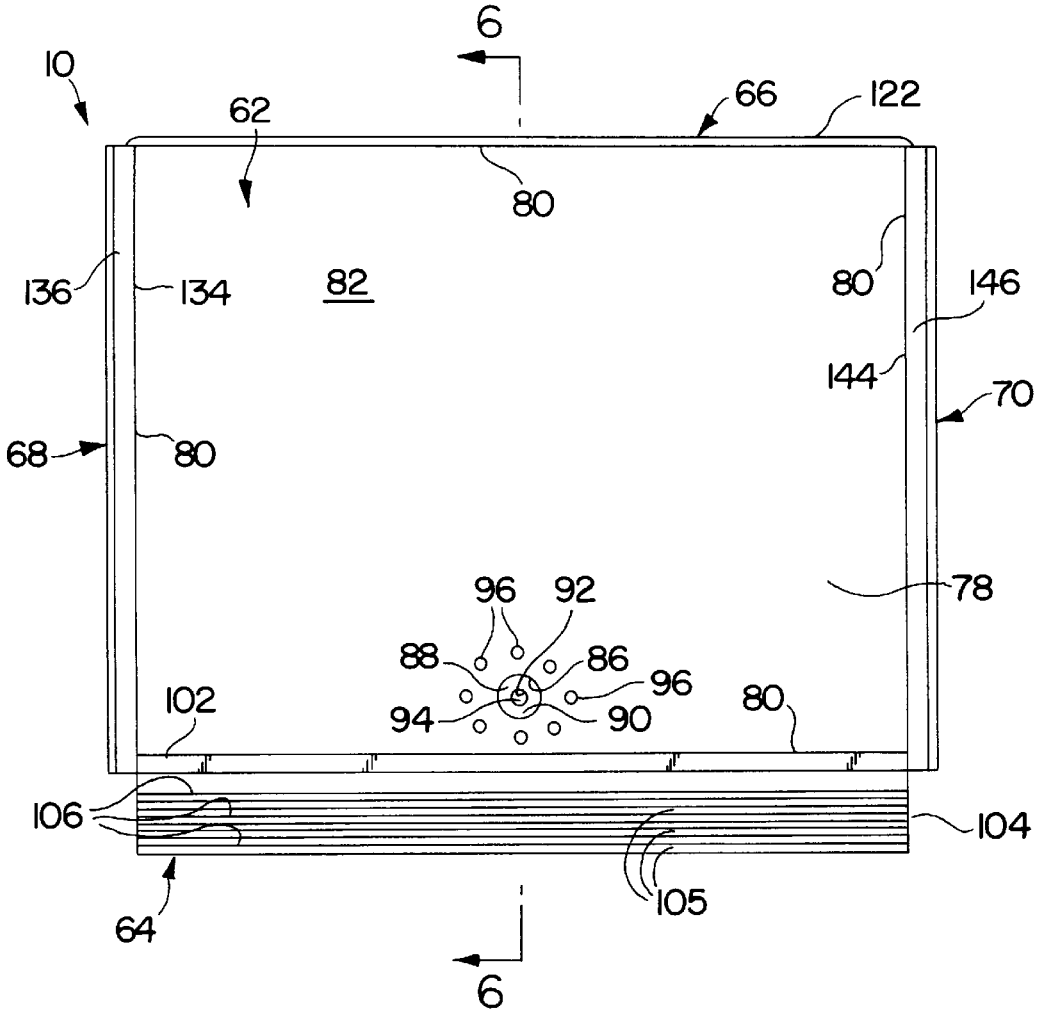
FIG. 4 is a plan view the receptacle in accordance with the present invention as illustrated in FIG. 3, prior to insertion within the cabinet.

As seen in FIGS. 1 and 2, a cabinet-sink-receptacle assembly 4 in accordance with the present invention is illustrated. Assembly 4 includes a cabinet 6, a sink 8, and a receptacle 10. Assembly 4 is preferably positioned on a surface or platform or floor 12 and positioned flush against a wall 14 as is known in the art. Receptacle 10 is primarily intended to be placed within cabinet 6 to catch fluid such as water that may be leaking from the plumbing or dripping from the plumbing in the form of condensate. Receptacle 10 directs the fluid out of cabinet 6 to an area where the fluid can is visible to the users of sink 8; such as on the flooring or tile 13 typically placed on top of floor 12.

Cabinet 6 has a cabinet foundation 16 positioned on floor 12 and a cabinet mounting structure 24 positioned, in turn, on foundation 16 for supporting sink 8 as is known in the art. Cabinet 6 is preferably made from wood.

Cabinet foundation 16 has a floor contacting section 18 and a support section 20. Floor contacting section raises support section 20 above floor 12 and flooring 13 as known in the art. Support section 20 is substantially planar and substantially horizontal and is positioned on top of floor contacting section 18. Support section 20 extends beyond floor contacting section 18 towards the front 21 of the cabinet 6 in the form of flange 22.

Flange 22 is spaced above flooring 13 to form toe receiving area 36 for a user of the sink, as is known in the art. The unique feature of flange 22 of the invention is the formation of a hole 23 extending completely through flange 22, providing a passageway from the area 25 within cabinet 6, through flange 22 to toe receiving area 36. Except for the formation of hole 23, cabinet 6 and sink 8 are generally known in the art. Preferably, support section 20 is made from a material that is easily drilled to facilitate the formation of hole 23.

Cabinet mounting structure 24 has access openings 26 between a center slat 27 as known in the art. Typically, the two access openings are closed by doors (not shown). Although two access openings 26 are disclosed, this is merely exemplary, as cabinet mounting structures with one access opening can be used. It should be understood that that cabinet 6 and sink 8 employed with the invention can be any cabinet and sink so long as the cabinet has some form of a support section similar to support section 20 in that it is capable of having a hole 23 formed therein for receiving the receptacle of FIGS. 1–6, or has at least one access opening for receiving the receptacle of FIG. 7. Typically, such cabinets 6 and sinks 8 are found in kitchens or bathrooms.

Sink 8 is illustrative of any known appropriate sink. Sink 8, as known in the art, has a faucet 32 and plumbing, both coupled to sink 8 such as by a fluid conductor or pipe 34, which delivers and removes the fluid, as is known in the art. Although the invention is preferably for use with a sink 8 for use with water, the invention can be used in any environment, including those outside the area of sinks and water. That is any environment where it is desired to catch fluid in a receptacle from a fluid conductor and direct the fluid away from the element on which the receptacle is positioned.

As seen in FIGS. 1–6, receptacle 10 has a base 62, a front member or front 64, a rear member or rear 66, a first side 68, and a second side 70, all coupled together. Preferably, receptacle 10 is integrally formed as a one-piece, unitary member. Alternatively, receptacle can be made from separate and distinct parts that are appropriately connected to provide the necessary water-tight or fluid-tight seals. Also, receptacle 10 is preferably formed from a polymeric material. For example, receptacle 10 can be formed from polypropylene, such as high density, low sag polypropylene. Such a material provides sufficient flexibility to enable receptacle 10 to be folded for insertion through small access openings 26 and then unfolded to its original state once inside cabinet 6 in area 25. Further, the material of receptacle 10 is preferably durable and easy to clean.

Receptacle 10 can be formed by any appropriate manufacturing technique. Preferably, receptacle 10 is formed by a molding process, as known in the field of plastics. Molding of receptacle 10 facilitates the mass production of receptacle 10 and is relatively inexpensive.

Base 62 has a receiving area 78 with a perimeter 80, an upper surface 82, and a lower surface 84. Preferably base 62 is generally planar and lower surface 84 lies in horizontal plane 85. Base 62 is preferably square or rectangular in shape in plan view to match the typical cabinet shape in which receptacle 10 is used. Therefore, after inserting receptacle in cabinet 6, most of the upper surface of support section 20 is covered by receptacle 10 to effectively seal and protect the inside of cabinet 6. Of course, base 62 and receptacle 10 can be of any shape desired or found necessary. Further, front 64, rear 66 and sides 68 and 70 can take any shape to match the shape of base 62 or to not match the shape of base 62.

Lower surface 84 is preferably a mating element for the upper surface of support section 20, thus, lower surface 84 is preferably substantially flat in a substantially horizontal plane. Upper surface 82 is also preferably substantially flat in a substantially horizontal plane since upper surface 82 can then firmly support various cans and containers that are typically stored under sinks and in cabinets such as cabinet 6. Thus, base 62 can act as a substitute upper surface of support section 20. An important feature of base 62 is to catch fluid such as water 152 leaking or otherwise coming from pipes 34 or other plumbing. If desired or necessary, upper surface 82 can be inclined in various configurations to more efficiently move fluid 152.

Base 62 also has an opening or drain hole 86 extending through upper surface 82. Drain hole 86 is aligned with a conduit or funnel or drain nipple 88, which extends through and below base 62. Although conduit 88 is preferably in the form of a funnel, conduit 88 can be tubular or be otherwise formed to be inserted into hole 23 in flange 22 to pass fluid 152 through hole 23.

Funnel 88 is preferably integral and unitary with base 62 to eliminate seams and provide for a fluid-tight seal between the elements. Funnel 88 has a top end 90 aligned with and positioned within drain hole 86, and a bottom end 92 opposite top end 90. Also, funnel 88 and opening 86 are preferably centered between walls 68 and 70. This enables the opening 86 to be hidden by center slat 27.

As discussed above, receptacle 10 is preferably molded. The mold to produce receptacle 10 is preferably arranged so that bottom end 92 is formed with a cap 94 that is integrally molded with the other elements of receptacle 10 and which closes bottom end 92 of funnel, resulting in an efficient and inexpensive molding process. Then, during installation or during preparation for installation, cap 94 is removed by cutting it off or drilling through it or by other conventional methods.

Alternatively, the mold to produce receptacle 10 can be configured to make funnel 88 in its final form, that is, the mold can produce a receptacle 10 having a funnel 88 with an open top end 90 and an open bottom end 92. This would then eliminate the need removing part of funnel 88 prior to installation. Of course, since receptacle and funnel 88 are preferably made from a somewhat flexible material, the bottom end 92, whether open or closed, can be modified by cutting or drilling or other methods to customize the fit of funnel 88 within hole 23.

Since upper surface 82 is intended to receive articles typically stored under a sink, it may occur that one of the articles would cover opening 86 and funnel 88 and prohibit fluid 152 from passing therethrough. Accordingly, upper surface 82 is preferably provided with at least one protrusion 96 extending around opening 86.

As seen in FIG. 2, a plurality of protrusions 96 are formed in a ring around opening 86 so that if an article such as container 150 is placed over opening 86, protrusions act to raise the container 150 above the upper surface 82 of base 62 to keep opening 86 unobstructed and to permit fluid 152 to pass through opening 86. Protrusions 96 can take any form that adequately supports an article such as container 150 above opening 86; such as generally semi-spherical as illustrated or arc-shaped. Also, instead of a plurality of protrusions, one continuous protrusion can be employed; such as in the form of a ring surrounding opening 86. Such a ring would have to be lower than the top of front wall 102 or have scores that are lower than the top of front wall 102 so that fluid 152 will flow through conduit or funnel 88 as preferred and not over front wall 102.

Front 64 has a main portion with a wall 102 and a frangible portion 104 coupled to the wall. Front 64 also has bottom surface 108, which is preferably coplanar with lower surface 84 in a substantially horizontal plane, when installed. Wall 102 extends completely between side walls 68 and 70 and is substantially perpendicular to base 62. Wall 102 is preferably shorter than sides 68 and 70 and rear 66 so that fluid 152 can flow over wall 102 before flowing over sides 68 and 70 and rear 66, if needed, in the event of a large flow of fluid 152. For this reason, and for ease of manufacturing, wall 102 is preferably smooth at its top. Also, wall 102 is preferably sufficiently strong to support any articles or containers stored in cabinet 6 that might be placed on wall 102, without deforming wall 102.

Frangible portion 104 has multiple individual sections 105 separated by perforations 106. This enables removal of sections 105 of frangible portion 104 for selectively sizing frangible portion 104 and, thus, selectively sizing receptacle 10 for fitting within differently sized cabinets 6. Sections 105 can be removed in any appropriate manner and any number of sections 105 can be removed. Although the section are separated by perforations, any type of indicia, including printing, or engraving or scoring can be used. Although preferably perforations are used which facilitate removal of sections 105, indicia can be used which merely indicates a line for cutting or removal of sections.

Rear 66 includes a wall 122 that extends completely between sides 68 and 70 and is substantially perpendicular to base 62. Wall 122 is preferably higher than front wall 102 so that fluid 152 is forced towards front 64 and drain hole 86.

First side 68 extends completely between front 64 and rear 66 and preferably has a first member 134 and a second member 136. Preferably, side 68 is higher than front wall 122 to force fluid 152 to front 66 and drain hole 86. Although side 68 can be formed as a single, continuos member, it is preferred that side has first member which is substantially perpendicular to base 62 and second member 136 which extends from first member 134 outwardly from base 62 in an inclined manner with respect to both the base 62 and the side 68. In other words, second member 136 is preferably inclined with respect to the horizontal plane and the vertical plane, in use. For manufacturing ease, member 134 preferably extends to the same height as rear wall 122.

Since side 68 is flexible and extends outwardly, side 68 can conform to differently sized cabinet areas 25. For example, in a wide cabinet area 25, side 68 can remain substantially in its inclined manner as described above and illustrated in FIG. 5. However, if receptacle 10 is used in a more narrow cabinet area 25, member 136 can be forced to take a position between its originally inclined position and the vertical position, substantially perpendicular to base 62.

Figure 5:
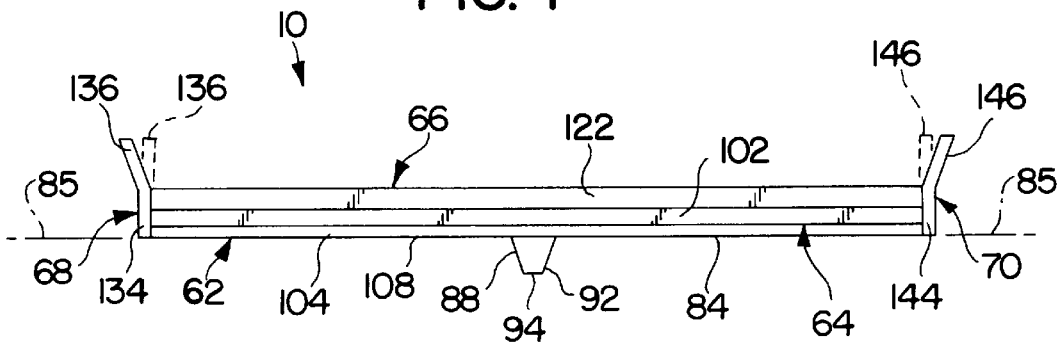
FIG. 5 is a front view the receptacle in accordance with the present invention as illustrated in FIG. 3, prior to insertion within the cabinet, with dashed lines illustrating a possible position for the flexible side walls upon installation in a cabinet.
Figure 6:
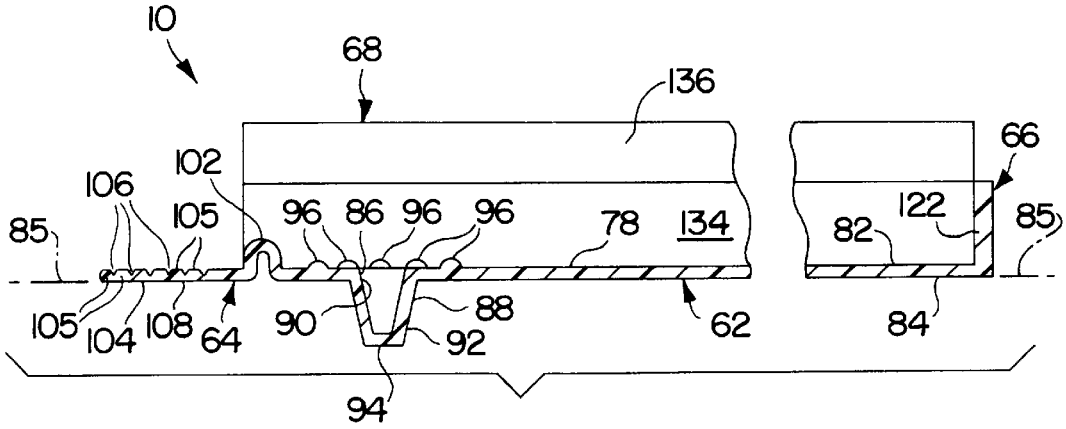
FIG. 6 is a cross-sectional view of the receptacle in accordance with the present invention as illustrated in FIG. 3, prior to insertion within the cabinet, and taken along lines 6—6 of FIG 4.

Dashed lines in FIG. 5 illustrate a possible position of member 136 when installed in a more narrow cabinet area 25 that requires member 136 to be flush with member 134. If greater positioning adjustability is needed or desired, side 68 can be formed of one larger inclined section.

Second side 70 has a first member 144 and a second member 146 that are substantially identical, but mirror images, of members 134 and 136 of first side 68. That is, side 70 is substantially identical to first side 70 except that it is located on the opposite side of base 62 and extends away from base 62 in an opposite direction than side 68. Therefore, second side 70 will not be described in detail.

Thus, receptacle 10 is basically a three-sided or three-walled receptacle with three generally vertical sides or walls. That is, wall 122 and sides 68 and 70 form three sides of receptacle 10, through which little or no fluid 152 should pass. Front wall 102 is preferably much shorter than wall 122 and sides 68 and 70 and subsequently, front wall 102 acts as a dam while the level of fluid 152 is below the top of wall 102, allowing fluid 152 to exit receptacle 10 only through conduit 88. If the level of fluid 152 rises above the top of wall 102, fluid 152 will spill over wall 102, but will not spill over rear wall 122 or sides 68 and 70. Fluid 152 then proceeds over frangible portion 104 and onto flooring 13.

It should be noted that walls 102, 122, 68 and 70 can be increased in size if desired to accommodate extreme out of level conditions caused by settlement of building or poor cabinet installation.

The preferred use of receptacle 10 involves initially inserting receptacle into cabinet area 25. If necessary, individual sections 105 can be removed so that the front 64 is substantially flush with the rear surface of center slat 27. The flexible nature of sides 68 and 70 will automatically adjust for the width of cabinet area 25 but, if necessary, sides 68 and 70 can be cut or shaped as necessary to form an appropriate fit. Hole 23 can be aligned and formed prior to installation, along with the removal of cap 94, if such exists. Then, receptacle is installed into cabinet area 25 and funnel 88 is received within hole 23. The combination of the flush fitting front 64 and the automatically fitting sides 68 and 70 provide what amounts to a seal of the cabinet area above support section 20. Then when fluid 152 leaks from pipe 34, the fluid 152 is caught by receptacle 10 and, due to gravity and the presence of walls 102, 122, 68, and 70, fluid 152 automatically flows to drain hole 86 and through funnel 88 onto flooring 13.

Thus, fluid 152 has been prevented from reaching the cabinet and from causing damage there to, especially to the surface of support section 20. A subsequent user of the assembly 4 will then notice the fluid 152 and can quickly take appropriate steps to rectify the problem. Additionally, articles can be stored on receptacle 10 without fear that they will prohibit flow of fluid 152 in any way since protrusions 96 will prohibit the blocking of drain hole 86.

Second Embodiment

Figure 7:
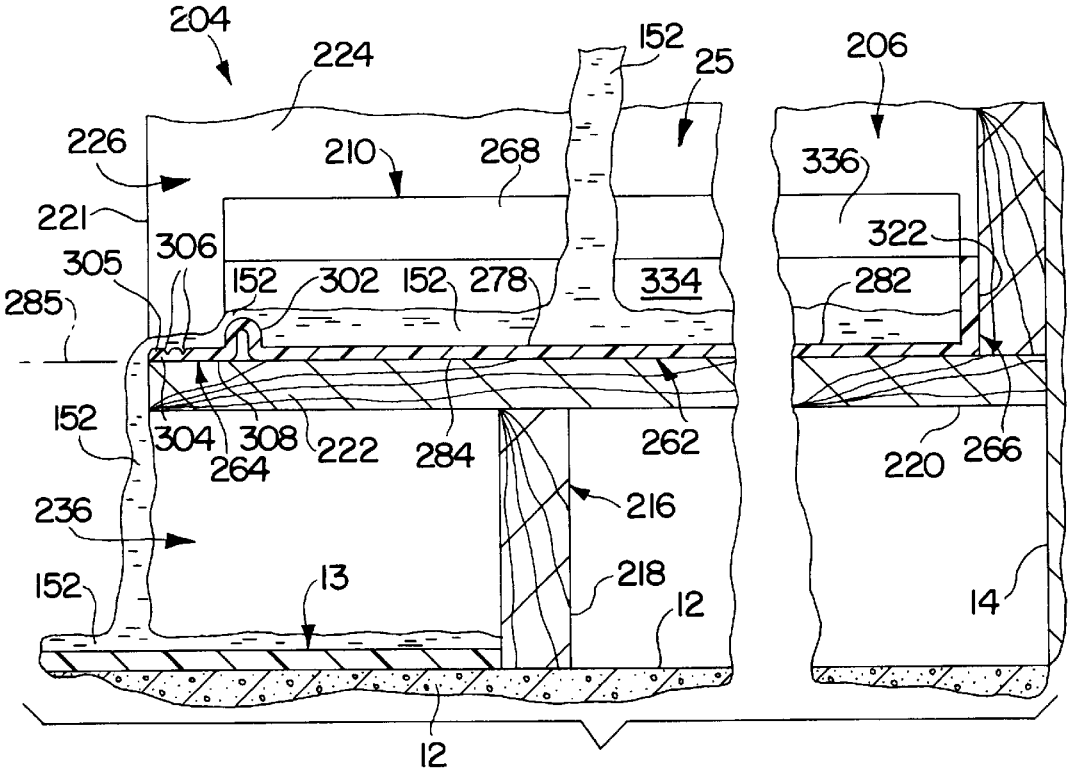
FIG. 7 is a cross-section view similar to FIG. 2, but illustrating a cabinet-sink-receptacle assembly in accordance with a second embodiment of the present invention, including illustrating the receptacle of the second embodiment located in its functioning position within the cabinet and illustrating water flowing from pipes caught by the receptacle and directed across the front of the receptacle and off the flange of the cabinet and onto the floor in front of the cabinet.

FIG. 7 illustrates a cabinet-sink-receptacle assembly 204 in accordance with a second embodiment of the present invention. Assembly 204 includes a cabinet 206, a sink (not shown), and a receptacle 210. Assembly 204 is preferably positioned on a surface or platform or floor 12 and positioned flush against a wall 14 as is known in the art. Receptacle 210 is primarily intended to be placed within cabinet 206 to catch fluid such as leaking water and direct the fluid out of cabinet 206 to an area where the fluid is visible to the users of the sink; such as on the flooring or tile 13 typically placed on top of a floor 12.

The assembly 204 of FIG. 7 is substantially identical to the assembly 4 of FIG. 1 except for the cabinet 206 not having a center slat 27, the flange 222 not having a hole 23 extending therethrough, and the receptacle 210 not having an opening 86, a funnel 88, or protrusions 96. Therefore, assembly 204 will only be described briefly.

Cabinet 206 has a cabinet foundation 216 positioned on floor 12 and a cabinet mounting structure 224 positioned, in turn, on foundation 216 for supporting the sink as is known in the art.

Cabinet foundation 216 has a floor contacting section 218 and a support section 220. Floor contacting section 218 raises support section 220 above floor 12 and flooring 13 as known in the art. Support section 220 is substantially planar and substantially horizontal and is positioned on top of floor contacting section 218. Support section 220 extends beyond floor contacting section 218 towards the front 221 of the cabinet 206 in the form of flange 222. Flange 222 is spaced above flooring 13 to form toe receiving area 236 for a user of the sink, as is known in the art. Cabinet mounting structure 224 has an access opening 226 as known in the art. Typically, the access opening is closed by a door(s) (not shown). Although one access opening 226 is disclosed, this is merely exemplary, as cabinet mounting structures with multiple access openings can be used. It should be understood that receptacle 210 can be used with cabinets other than cabinet 206, especially cabinets that do not have raised support section.

Receptacle 210 has a base 262, a front member or front 264, a rear member or rear 266, a first side 268, and a second side (not shown), all coupled together. Preferably, receptacle 210 is integrally formed as a one-piece, unitary member. Also, receptacle 210 is preferably formed from a polymeric material.

Base 262 has a receiving area 278 with a perimeter 280, an upper surface 282, and a lower surface 284. Preferably base 262 is generally planar and lower surface 284 lies in horizontal plane 285. Base 262 is continuous and without openings. Also, base 262 is preferably square or rectangular in shape in plan view to match the typical cabinet shape in which receptacle 210 is used. Therefore, most of the upper surface of support section 220 is covered by receptacle 210. Of course, base 262 and receptacle 210 can be of any shape desired or found necessary. Further, front 264, rear 266, side 268 and the second side can take any shape to match the shape of base 262 or to not match the shape of base 262.

Front 264 has a main portion with a wall 302 and a frangible portion 304 coupled to the wall. Front 264 also has bottom surface 308, which is preferably coplanar with lower surface 284 in a substantially horizontal plane, when installed. Wall 302 extends completely between first side 268 and the second side and is substantially perpendicular to base 262. Wall 302 is preferably shorter than side 268 and the second side and rear 66 so that fluid 152 can flow over wall 302 before flowing over side 268, the second side, and rear 66.

Frangible portion 304 has multiple individual sections 305 separated by perforations 306. This enables removal of sections 305 of frangible portion 304 for selectively sizing frangible portion 304 and, thus, selectively sizing receptacle 210 for fitting within differently sized cabinets 206. Sections 305 can be removed in any appropriate manner and any number of sections 305 can be removed.

Rear 266 includes a wall 322 that extends completely between side 268, the second side, and is substantially perpendicular to base 262. Wall 322 is preferably higher than front wall 302 so that fluid 152 is forced towards front 264.

First side 268 extends completely between front 264 and rear 266 and preferably has a first member 334 and a second member 336. Preferably, side 268 is higher than front wall 322 to force fluid 152 to front 366.

The second side (not shown) opposite to side 268 is substantially identical to first side 268 and second side 70 of receptacle 10, and therefore, the second side of receptacle 210 is not described in detail herein.

The preferred use of receptacle 210 involves initially inserting receptacle into cabinet area 225 in a manner substantially identical to that described above with respect to receptacle 210 except it is not necessary to drill a hole in flange 222 or manipulate a conduit such as funnel 88. Since base 262 is without any openings, when fluid 152 drips onto receptacle 210, the fluid 152 is caught by receptacle 210. Then, due to gravity and the presence of walls 322, 268, and the second side, fluid 152 automatically flows to front 256, over front wall 302, and then off the edge of frangible portion 304 and flange 222 and onto flooring 13. A subsequent user of the assembly 204 will then notice the fluid 152 and can quickly take appropriate steps to rectify the problem.

Receptacle 210 is desirable where no center slat 27 exists and where a hole such as hole 23 in the flange 222 of the cabinet 206 might be unsightly. If a center slat 27 exists, receptacle 10 along with hole 23 can be employed without noticing the hole 23, since the center slat 27 hides the hole.

Additionally, receptacle 210 is especially desirable where a toe receiving area 236 does not exist or where support section 220 is not raised, thus, making it impossible to use a funnel 88 as described with respect to receptacle 10.

Although the description has detailed receptacles 10 and 210 for use primarily with pipes 34 located above the receptacles 10 and 210, it should be understood that receptacles could be appropriately modified to accommodate pipes that extend through the floor 12 instead of through the walls 14. That is, the receptacles 10 and 210 can be modified to have openings or passageways therethrough to receive pipes that must pass through receptacles 10 and 210.

While advantageous embodiments have been chosen to illustrate the invention, it will be understood by those skilled in the art from this disclosure that various changes and modifications can be made therein without departing from the scope of the invention as defined in the appended claims.

What is claimed is:

1. A receptacle for receiving fluid, comprising:

a base having a receiving area, a front member coupled to said base;

a rear member coupled to said base; and first and second sides coupled to said base, said receiving area having a perimeter and being defined by said front member, said rear member, and said first and second sides adjacent said perimeter, and said rear member, and said first and second sides extending above said receiving area, one or more sections of said base, said front member, said rear member, and said first and second sides forming a support portion for supporting said receptacle, said support portion lying in a substantially horizontal first plane, and said first side being flexible and having an adjustable positioning portion, which is adjustable between a first position and a second position, wherein at least a section of said adjustable positioning portion lies in a second plane.

2. A receptacle for receiving fluid, comprising:

a base having a receiving area, a front member coupled to said base;

a rear member coupled to said base; and first and second sides coupled to said base, said receiving area having a perimeter and being defined by said front member, said rear member, and said first and second sides adjacent said perimeter, and said rear member, and said first and second sides extending above said receiving area, one or more sections of said base, said front member, said rear member, and said first and second sides forming a support portion for supporting said receptacle, said support portion lying in a substantially horizontal first plane, and said first side being flexible and having an adjustable positioning portion, said adjustable positioning portion extending in a first direction that is generally away from said receiving area and inclined with respect to said first plane and inclined with respect to a substantially vertical, second plane, which is substantially perpendicular to said first plane.

3. A receptacle according to claim 2, wherein, said front extends from said perimeter of said base in a second direction that is generally away from said receiving area and said front member has a bottom surface which is substantially coplanar with said first plane, said front member further has a main portion and a frangible portion, said main portion being coupled to said base and said frangible portion being coupled to said main portion by a perforation such that said frangible portion can be selectively separated from said main portion.

4. A receptacle according to claim 3, wherein, said receiving area has an upper surface and a lower surface and an opening in said upper surface, said receiving area further has a funnel coupled to said lower surface and extending below said lower surface, said upper surface having a first portion, which is substantially planar and substantially horizontal, said first portion having at least one protrusion extending above said upper surface and extending around said opening.

5. A receptacle according to claim 4, wherein said second side is flexible and has a portion extending from said base in a third direction that is generally away from said receiving area and inclined with respect to said first plane and said second plane.

6. A receptacle according to claim 5, wherein said lower surface of said receiving area is substantially planar and forms said support portion.

7. A receptacle according to claim 6, wherein each of said first and second sides has a first member which is substantially perpendicular to said bottom portion of said base and a second member which extends upwardly away from said first member.

8. A receptacle according to claim 7, wherein said receptacle is formed completely from polymeric material.

9. A receptacle according to claim 8, wherein said receptacle is formed from polypropylene and is integrally formed as a unitary, one-piece member.

10. A receptacle for receiving fluid, comprising:

a base having a receiving area, a front member coupled to said base;

a rear member coupled to said base; and first and second sides coupled to said base, said receiving area having a perimeter and being completely surrounded by said front member, said rear member, and said first and second sides adjacent said perimeter, and said rear member, and said first and second sides extending above said receiving area, one or more sections of said base, said front member, said rear member, and said first and second sides forming a support portion for supporting said receptacle, said support portion lying in a substantially horizontal first plane, and said front member extending from said base in a first direction that is generally away from said receiving area and said front member having a bottom surface being substantially coplanar with said first plane, said front member further having a main portion and a frangible portion for selectively removing from said receptacle.

11. A receptacle according to claim 10, wherein said main portion is coupled to said base and said frangible portion is coupled to said main portion by a perforation such that said frangible portion can be selectively separated from said main portion.

12. A receptacle according to claim 11, wherein said frangible portion has additional lines of perforations.

13. A receptacle according to claim 12, wherein said receptacle is formed completely from polymeric material.

14. A receptacle for receiving fluid, comprising:

a base having a receiving area, said receiving area having a perimeter, an upper surface, a lower surface, and an opening in said upper surface, said base further having a conduit coupled to said lower surface and extending below said lower surface;

a front member coupled to said base;

a rear member coupled to said base; and first and second sides coupled to said base, said receiving area being defined by said front member, said rear member, and said first and second sides adjacent said perimeter, and said rear member and said first and second sides extending above said receiving area, said receptacle being integrally formed as a unitary, one-piece member, and said conduit being a funnel having a first open end and a second closed end.

15. A receptacle for receiving fluid, comprising:

a base having a receiving area, said receiving area having a perimeter, an upper surface, a lower surface, and an opening in said upper surface, said base further having a conduit coupled to said lower surface and extending below said lower surface;

a front member coupled to said base;

a rear member coupled to said base; and first and second sides coupled to said base, said receiving area being defined by said front member, said rear member, and said first and second sides adjacent said perimeter, and said rear member and said first and second sides extending above said receiving area, said receptacle being integrally formed as a unitary, one-piece member, and said upper surface being substantially planar and substantially horizontal along substantially the entire extent of said upper surface except for at least one annular protrusion extending above said upper surface and extending annularly around said opening in an area immediately adjacent said opening.

16. A receptacle according to claim 15, wherein said at least one protrusion is multiple protrusions extending above said upper surface and extending around said opening.

17. An assembly for receiving fluid, comprising:

a cabinet foundation for positioning on a floor, said cabinet foundation having a lower, floor contacting section and a support section positioned above said floor contacting section, said support section having a flange extending beyond and cantilevered from said floor contacting section, said flange having a hole extending completely through said flange and said hole being spaced from the floor and spaced from said floor contacting section; and a receptacle positioned on said support section, said receptacle having a base, a front member coupled to said base, a rear member coupled to said base, and first and second sides coupled to said base, said base having a receiving area having a perimeter, an upper surface, a lower surface, and an opening extending completely through said receiving area between said upper and lower surfaces and said opening being aligned with said hole in said flange to permit fluid to pass from said upper surface of said base, through said base and said flange, and onto the floor, and said receiving area being defined by said front member, said rear member, and said first and second sides adjacent said perimeter, and said rear member and said first and second sides extending above said receiving area.

18. An assembly according to claim 17, further comprising:

a cabinet mounting structure coupled to said cabinet base, and a sink coupled to said cabinet mounting structure.

19. An assembly according to claim 18, wherein said base has a conduit coupled to said lower surface of said receiving area and said conduit has an open first end aligned with said opening in said upper surface of said receiving area and an open second end extending into said hole in said flange.

20. A method for directing fluid from a fluid conductor to a platform, comprising the steps of:

providing a fluid conductor above a platform;

providing a cabinet foundation positioned on the platform, the foundation having a lower, platform contacting section and a support section positioned above the platform contacting section, the support section having a flange extending beyond and cantilevered from the platform contacting section, the flange having a hole extending completely therethrough and being spaced from the platform and spaced from the platform contacting section;

providing a receptacle having a base, a front member coupled to the base, a rear member coupled to the base, and first and second sides coupled to the base, the base having a receiving area having a perimeter, an upper surface, a lower surface, and an opening extending completely through the receiving area between the upper and lower surfaces;

positioning the receptacle on the support section of the foundation beneath the fluid conductor such that the opening of the receptacle is aligned with the hole in the flange of the cabinet base; and directing fluid from the fluid conductor to the platform by permitting the fluid to flow onto the receptacle and then pass through the opening in the receptacle and through the hole in the flange without permitting the fluid to collect within the platform contacting section.

21. A method according to claim 20, where the step of providing a fluid conductor above a platform includes providing a fluid conductor in the form of a pipe above a platform in the form of a floor.

* * * * *